US011097504B2

(12) United States Patent
Desertot

(10) Patent No.: US 11,097,504 B2
(45) Date of Patent: Aug. 24, 2021

(54) METHOD AND DEVICE FOR SHAPING A BLANK AROUND A MANDREL

(71) Applicant: DS SMITH PACKAGING FRANCE, Puteaux (FR)

(72) Inventor: Didier Desertot, Arc-sur-Tille (FR)

(73) Assignee: DS SMITH PACKAGING FRANCE, Puteaux (FR)

( * ) Notice: Subject to any disclaimer, the term of this patent is extended or adjusted under 35 U.S.C. 154(b) by 86 days.

(21) Appl. No.: 16/340,889

(22) PCT Filed: Oct. 9, 2017

(86) PCT No.: PCT/FR2017/052758
§ 371 (c)(1),
(2) Date: Apr. 10, 2019

(87) PCT Pub. No.: WO2018/069614
PCT Pub. Date: Apr. 19, 2018

(65) Prior Publication Data

US 2019/0232596 A1 Aug. 1, 2019

(30) Foreign Application Priority Data

Oct. 11, 2016 (FR) ..... 1659819

(51) Int. Cl.
*B31B 50/26* (2017.01)
*B31B 50/28* (2017.01)
(Continued)

(52) U.S. Cl.
CPC ..... *B31B 50/282* (2017.08); *B31B 50/00* (2017.08); *B31B 50/28* (2017.08); *B31B 50/62* (2017.08);
(Continued)

(58) Field of Classification Search
CPC ..... B31B 50/00; B31B 50/08; B31B 50/28; B31B 50/282
See application file for complete search history.

(56) References Cited

U.S. PATENT DOCUMENTS 2,256,263 A * 9/1941 Haycock ..... B31C 5/00 493/274
2,776,608 A * 1/1957 Fischer ..... B31B 50/00 493/110
(Continued)

FOREIGN PATENT DOCUMENTS

EP 0334707 A1 * 9/1989 ..... B31B 50/00
EP 0468860 A1 * 1/1992 ..... B65D 5/001
(Continued)

OTHER PUBLICATIONS

International Search Report and Written Opinion for PCT/FR2017/052758 dated Jan. 3, 2018. [English Translation Provided].

*Primary Examiner* — Andrew M Tecco
*Assistant Examiner* — Eyamindae C Jallon
(74) *Attorney, Agent, or Firm* — Thomas|Horstemeyer, LLP

(57) ABSTRACT

The present invention relates to a device for shaping a blank (1) of material in sheet form around a mandrel, in order to obtain a box or part of box of polygonal cross section, comprising: —a mandrel, —means for wrapping around the mandrel, —means for securing the tab, —means for folding the flaps, and—means for securing to one another, the flaps thus folded. The means for wrapping the panels and the means for securing the tab are supported by two cradles positioned one on each side of the mandrel, transversely and symmetrically with respect to the direction in which the blank is brought in from the glue-application workstation.

16 Claims, 9 Drawing Sheets

(51) Int. Cl.

| | |
|---|---|
| ***B31B 50/62*** | (2017.01) |
| ***B31B 50/00*** | (2017.01) |
| *B31B 50/06* | (2017.01) |
| *B31B 50/07* | (2017.01) |
| *B31B 100/00* | (2017.01) |

(52) U.S. Cl.
CPC ..... *B31B 50/06* (2017.08); *B31B 50/07* (2017.08); *B31B 2100/0022* (2017.08)

(56) References Cited

U.S. PATENT DOCUMENTS

| | | | | |
|---|---|---|---|---|
| 4,164,171 | A * | 8/1979 | Meyers | B31B 50/00 198/404 |
| 4,708,706 | A * | 11/1987 | Doderer | B31B 50/00 493/164 |
| 5,400,955 | A * | 3/1995 | Coalier | B65D 5/008 229/103.3 |
| 7,857,743 | B2 * | 12/2010 | Barner | B65D 5/48024 493/175 |
| 8,133,163 | B2 * | 3/2012 | Strong | B65D 5/10 493/175 |
| 2003/0119640 | A1 * | 6/2003 | Jaen | B31B 50/00 493/162 |
| 2015/0367589 | A1 | 12/2015 | Graham et al. | |

FOREIGN PATENT DOCUMENTS

| | | | |
|---|---|---|---|
| FR | 0334707 | A1 | 9/1989 |
| FR | 2775658 | A1 | 9/1999 |
| JP | S50 113380 | A | 9/1975 |
| WO | 9604129 | A1 | 2/1996 |

* cited by examiner

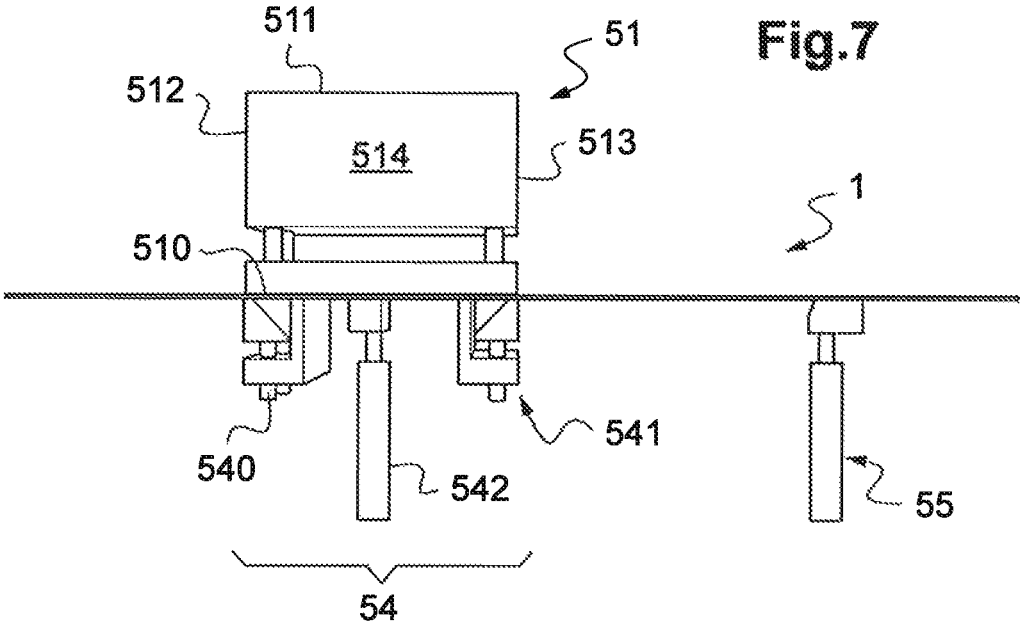
Fig.7
Fig.9
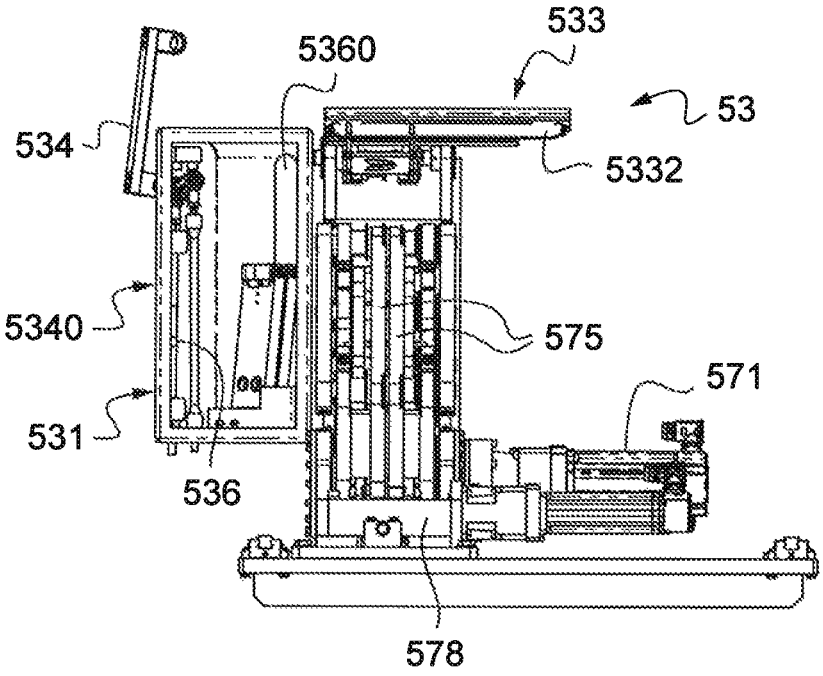

METHOD AND DEVICE FOR SHAPING A BLANK AROUND A MANDREL

CROSS-REFERENCE TO RELATED APPLICATIONS

This application is the 35 U.S.C. § 371 national stage application of PCT Application No. PCT/FR2017/052758, filed Oct. 9, 2017, where the PCT claims the priority to and benefit of French Patent Application No. 1659819, filed Oct. 11, 2016, both of which are herein incorporated by reference in their entireties.

The present invention relates to a device for shaping a blank made of material in sheet form around a mandrel, to obtain a box or part of box of polygonal cross section.

It also relates to a method for shaping a blank made of material in sheet form.

This blank conventionally comprises a continuation of at least three panels, namely two extreme panels situated on either side of at least one intermediate panel, said panels being connected to one another by parallel folding lines and provided with side flaps, connected respectively to said panels by folding lines perpendicular to the folding lines connecting said panels, the free edge of one of the extreme panels being provided with a tab connected to said extreme panel by a folding line parallel to the folding lines connecting said panels.

When the blank comprises three panels, it makes it possible to obtain a part of box (cover or bottom). When it comprises at least four panels, it makes it possible to obtain a box.

To make it possible to obtain a box or a part of box, an adhesive is deposited, on the one hand, on two side flaps and on the other hand, on said tab of an extreme panel or in the proximity of the free edge of the extreme panel opposite said tab.

Then, the panels are wrapped around a mandrel of polygonal cross section of which the outer cross section corresponds to the inner cross section of the box to obtain, the tab is secured against the free edge of the other extreme panel born against the upper face of the mandrel, and the flaps being located on the same side of said panels are folded against a corresponding end face of the mandrel then secured to one another.

This invention has a particular significant, although non-exclusive application, in the field of corrugated cardboard reinforced boxes.

From numerous methods and devices for shaping a blank around a mandrel are already known.

In particular, document EP 0 334 707 which describes a method and a device consisting of successively removing blanks in a magazine and depositing them on a table equipped with driving fingers can be cited. The latter make the blank slide over the table to ring it under the mandrel. During the transfer to the mandrel, the blank meets gluers arranged above and below the table which deposit adhesive lines on the blank.

The shaping of the blank around the mandrel is done using mobile equipment likely to be moved in translation, perpendicularly to the plane of the blank, and comprising abutments and hinged arms to wrap around the panels and the tab around the mandrel, as well as actuators secured to the frame.

The securing of the tab against the free edge of the extreme panel opposite the tab, the folding of the flaps being located on the same side of the panels against a corresponding end face of the mandrel and the securing to one another of the folded flaps are achieved by a hinged arm and actuators, also secured to the frame.

Numerous variants of this device have been proposed and they bring overall satisfaction.

These devices however have disadvantages, as they all require the intervention of numerous devices, independent of one another, which must therefore be precisely adjusted to be able to ensure a correct shaping of the blank and which also lead to a significant volume.

The invention aims to overcome these disadvantages by proposing a device and a method for shaping a blank made of material in sheet form around a mandrel making it possible to achieve this shaping with a great precision, while being a design and/or a simplified implementation.

To this end, the invention proposes, in particular, a device for shaping a blank made of material in sheet form around a mandrel, to obtain a box or a part of box of polygonal cross section, said blank comprising a continuation of at least three panels, namely two extreme panels on either side of at least one intermediate panel, said panels being connected to one another by parallel folding lines and provided with side flaps, connected respectively to said panels by folding lines perpendicular to the folding lines connecting said panels, the free edge of one of the extreme panels being provided with a tab connected to said extreme panel by a folding line parallel to the folding lines connecting said panels, said blank being glued beforehand in a glue-application workstation, on the one hand, on two flaps, and on the other hand, on the tab of the extreme panel or in the proximity of the free edge of the extreme panel opposite to said tab, the device comprising:

- a frame,
- a mandrel of polygonal cross section, of which the outer cross section corresponds to the inner cross section of the box or part of the box to be obtained,
- means for wrapping the panels and the tab around the mandrel,
- means for securing the tab against the free edge of the extreme panel opposite the tab,
- means for folding the flaps located on the same side of said panels against a corresponding end face of the mandrel, and means for securing to one another, the flaps thus folded, characterised in that the means for wrapping the panels and the means for securing the tab are supported by two cradles secured to the frame of the device and arranged on either side of the mandrel, transversally and symmetrically with respect to the direction in which the blank is brought in from the glue-application workstation.

A part of the box is, in particular, a cover or a bottom.

In advantageous embodiments, moreover and/or in addition, one and/or the other of the following arrangements are resorted to:

- the means for wrapping each cradle comprise means equipped with a sliding surface to lower a panel of the blank on one of two side faces opposite the mandrel and respectively, for one of the cradles, means to lower a panel and for the other cradle, means to fold the tab around the edge of the upper face of the mandrel, the cradles each comprise a hinged system to vertically and transversally move the wrapping means;
- the means to lower a panel comprise a first hinged arm, mounted mobile in rotation on the means equipped with a sliding surface;
- the other cradle also supports the means to secure the tab, these means comprising a second hinged arm mounted in rotation on the means equipped with a sliding surface of said cradle and equipped with means to compress the tab against the free edge of the extreme panel opposite;

at least some of the means to fold flaps is also supported by the two cradles;

the device comprises means for support or maintain at least some of the surface of an intermediate panel of the blank and the mandrel comprises a face to apply said intermediate panel on the support or maintenance means, side faces and an upper face opposite the application face;

the mandrel is mobile between a first position to form the box or part of box, wherein the outer cross section thereof corresponds to the inner cross section of the box or part of box to be obtained and a second retracted position wherein the distance between the application face of the mandrel and the opposite face thereof is less than the width of the box or part of box to be obtained;

the distance between the application face and the face opposite the mandrel can be adjusted;

the edges of the mandrel have cut corners.

The invention also relates to a method for shaping a blank of material in sheet form around a mandrel to obtain a box or a part of box of polygonal cross section, said blank comprising a continuation of at least three panels, namely two extreme panels on either side of at least one intermediate panel, said panels being connected to one another by parallel folding lines and provided with side flaps, connected respectively to said panels by folding lines perpendicular to the folding lines connected said panels, the free edge of one of the extreme panels being provided with a tab connected to said extreme panel by a folding line parallel to the folding lines connecting said panels, method implementing a device equipped with a frame and wherein the blank being glued beforehand at a glue-application workstation of the device, the panels are wrapped around a mandrel of polygonal cross section of which the outer cross section corresponds to the inner cross section of the box or of the part of box to be obtained, the tab is secured against the free edge of the other extreme panel born against the upper face of the mandrel, the folds being located on the same side of said panels are folded against a corresponding end face of the mandrel then secured to one another, characterised in that the wrapping of the panels and of the tab, as well as the securing of said tab result from translation and rotation movements made by means supported by two cradles secured to the frame of the forming device, arranged on either side of the mandrel, transversally and symmetrically with respect to the direction in which the blank in brought in from the glue-application workstation.

Advantageously, moreover and/or in addition, one and/or the other of the following arrangements are resorted to:

the folding of at least some of the flaps is also done from means supported by the cradles;

the mandrel comprises an application face of the intermediate panel on support or maintenance means of the forming machine for at least some of the surface of the intermediate panel, the mandrel being in a retracted position, wherein the distance between the application face of the intermediate panel and the upper face opposite the mandrel is less than the width of the box or part of box to be obtained, when the blank coming from the glue-application workstation is positioned under the mandrel, and in a forming position, wherein the outer cross section of the mandrel corresponds to the inner cross section of the box or a part of the box to be obtained, once the intermediate panel on the support or maintenance means, to press said intermediate panel on the support or maintenance means by means of the application face of the mandrel;

the blank is brought in from the glue-application workstation under the mandrel by a translation movement of direction parallel to the folding lines between the panels of the blank, the mandrel being arranged at the fixed workstation;

the blank is secured by suctioning with the means ensuring the translation movement thereof to ensure the precise positioning thereof under the mandrel.

The invention also relates to a machine for forming a box or a part of box of polygonal cross section comprising a glue-application workstation, wherein a blank made of material in sheet form, comprising a set of panels connected to one another by parallel folding lines and provided with side flaps, connected respectively to said panels by folding lines perpendicular to the folding lines connected said panels, the free edge of one of the extreme panels of said set of panels being provided with a tab connected to said extreme panel by a folding line parallel to the folding lines connecting said panels, is glued at least, on the one hand, on two side flaps and, on the other hand, on the tab of an extreme panel or in the proximity of the free edge of the extreme panel opposite said tab and a forming workstation comprising the shaping device such as described above.

The invention also relates to a method for forming a box or a part of box of polygonal cross section from a blank comprising a set of panels connected to one another by parallel folding lines and provided with side flaps, connected respectively to said panels by folding lines perpendicular to the folding lines connecting said panels, wherein the blank is glued in a glue-application workstation, then shaped around a mandrel by implementing the shaping method described above.

The invention finally relates to a method for successively, automatically forming boxes or parts of boxes implementing a method for forming a box or part of box according to the invention, wherein the blank n−1 is formed during the gluing of the blank n.

The invention will be best understood and the advantages thereof will appear more clearly upon reading the following description of embodiments given as non-limiting examples. The description refers to the drawings which accompany it, wherein:

FIG. 7 is a view, similar to FIG. 6 representing the mandrel in the forming position.

FIG. 9 is a side view of one of the cradles.

The elements common to the different figures will be designated by the same references.

Figure 1:
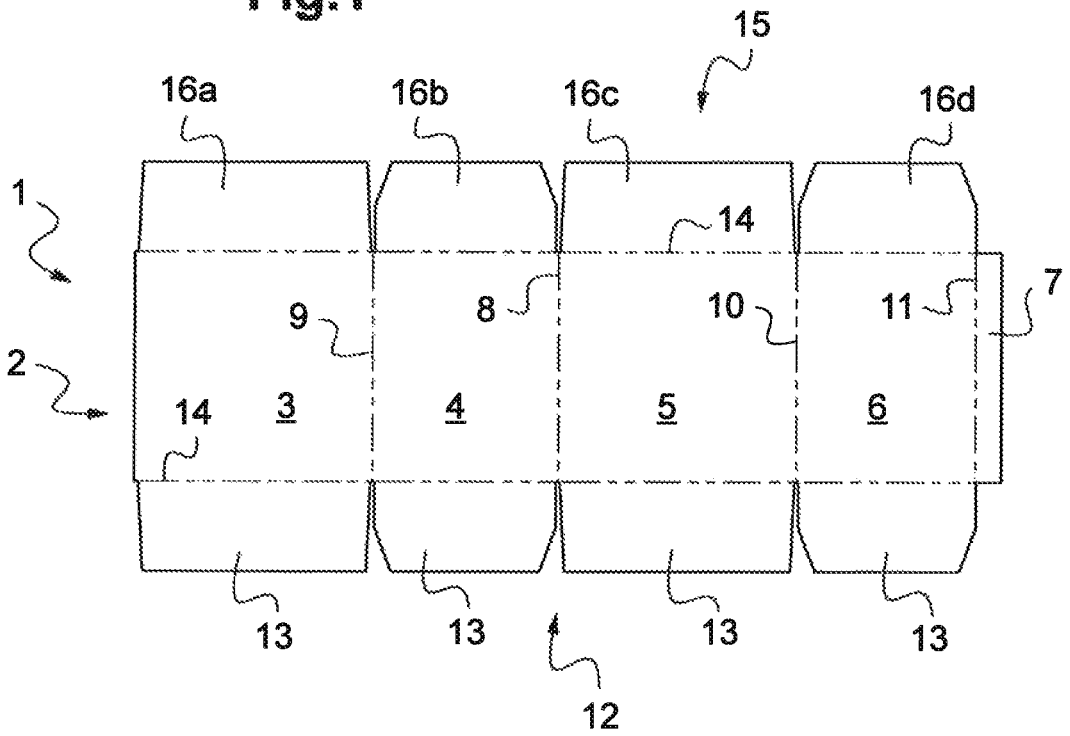
FIG. 1 shows, in a top view, an embodiment of a blank which can be used with the method and the gluing device according to the invention.

FIG. 1 shows a blank 1 made of two-sided corrugated cardboard, for example of thickness 3 mm intended to form a box.

It comprises a continuation 2 of four main, rectangular panels 3, 4, 5, 6 ended by a gluing tab 7 and connected to one another by first folding lines, parallel to one another, namely a first central or reference folding line 8, two first side folding lines 9 and 10, and a first end folding line 11, joined to the tab 7.

The panels 3 and 6 are called extreme panels and the panels 4 and 5, intermediate panels.

The blank comprises, in itself, in a known manner, a first set 12 of rectangular or substantially rectangular flaps 13 connected to the main panels by second folding lines 14 perpendicular to the first folding lines, and specific to forming the top of the box after filling and a second set 15 of rectangular or substantially rectangular flaps 16*a* to 16*d* also connected to the main panels by second folding lines 14 and specific to forming the bottom of the box.

The method and the device according to the invention can also use variants of the blank illustrated in FIG. 1 and in particular a blank comprising main rectangular panels connected to one another by secondary rectangular panels.

In a known manner, these secondary panels form, on the final box, the bevelled angles of the latter.

They can also use blanks comprising an intermediate panel and two extreme panels to obtain a part of box.

First, reference is made to FIGS. 2 to 5 to describe a machine for forming a box of polygonal cross section from the blank illustrated in FIG. 1, this machine comprising a gluing device according to the embodiment of the invention, more specifically described here, in particular in reference to the other figures.

This machine 20 comprises a frame or structure 21 forming a platform carrying subsets or independent modules, assembled to ensure the forming of a box from the blank illustrated in FIG. 1.

This is the blank storage/unstacking module 30, the blank gluing module 40, the forming module 50, and the extraction module 60.

These modules can be produced independently and then mounted on the frame 22.

Thus, the frame 21 ensures the connection between the two end modules, namely the storage/unstacking module 30 and the extraction module 60.

In the posts 22 of the frame, an electrical cabinet can be provided, which comprises a programmable automaton for controlling the machine, known in itself.

The first storage/unstacking module 30 comprises a storage magazine 31 in the semi-vertical position of the blanks 1 to be formed.

This comprises two modular chains 32 driven by a system 33, comprising for example an asynchronous motor.

The chains 32 are for example coupled with a freewheel 34 and make it possible to maintain a blank ready to be supplied in the front part 36.

In the storage magazine 31, the blanks are stored with the printed face rotated towards the outside of the machine and the tab of the blank located on the right-hand side of the machine in the scrolling direction of the blanks.

This module 30 also comprises means 35 (see FIG. 3) for unstacking blanks 1 from the magazine 31.

The gluing module 40 comprises a gluing device with a flat support 41 such as a table, intended to receive a blank 1. On the longitudinal edges of this table 41, cleats 410 are provided, secured with respect to the table, making it possible to ensure the positioning of the blank.

The gluing device also comprises a hinged arm system 42 supporting a nozzle 420 positioned above the support.

The forming module 50 comprises a mandrel 51, i.e. a shaping tool, around which the blank glued beforehand by the gluing device will be shaped.

To move the blank 1 from the gluing device to under the mandrel 51, transfer means 43 are provided, comprising a hinged arm system, located under the table 41 and likely to seize from below, a blank by suction means.

The forming module 50 (see FIG. 4) itself comprises two cradles 52, 53 secured to the frame 21 and arranged on either side of the mandrel 51, transversally and symmetrically with respect to the direction in which the blank is brought in from the glue-application workstation.

These cradles comprise, in the example illustrated in FIGS. 2 to 5, the means for wrapping the panels and the means for securing the tab.

The extraction module 60 comprises an extraction workstation to extract a box or part of a part of polygonal cross section from the mandrel 51 where it has been formed, using an extraction device 61, an evacuation workstation comprising the two conveyors 62, 63 as well as a workstation for transferring boxes or parts of boxes from the extraction workstation to the evacuation workstation.

The forming module 50 will now be described in more detail as regards FIGS. 6 to 14.

Figure 6:
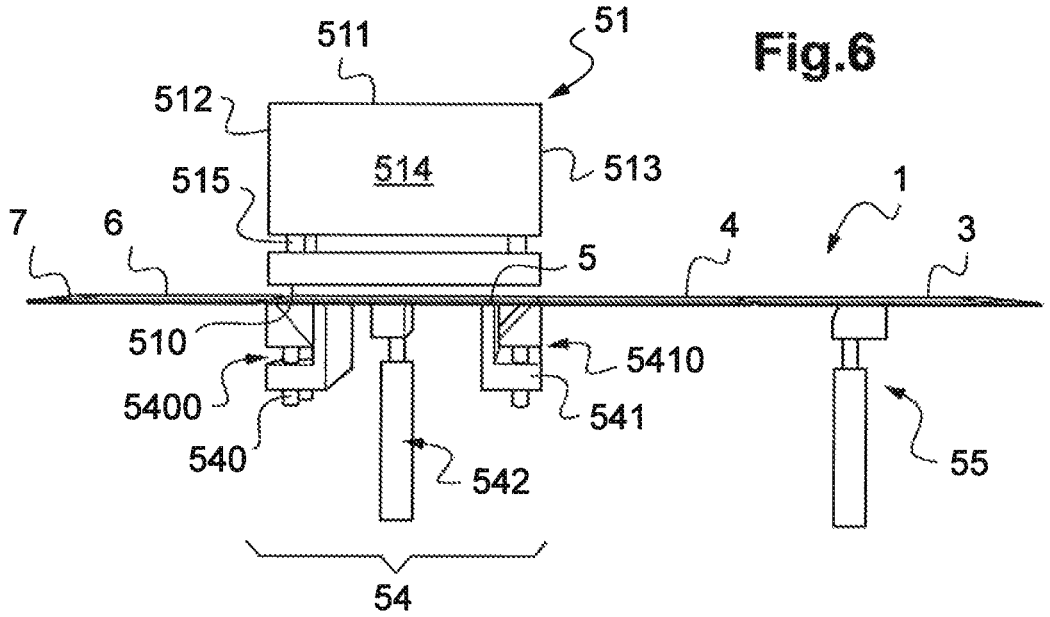
FIG. 6 is a cross-sectional view of the forming workstation, illustrating the mandrel in the retracted position.
Figure 2:
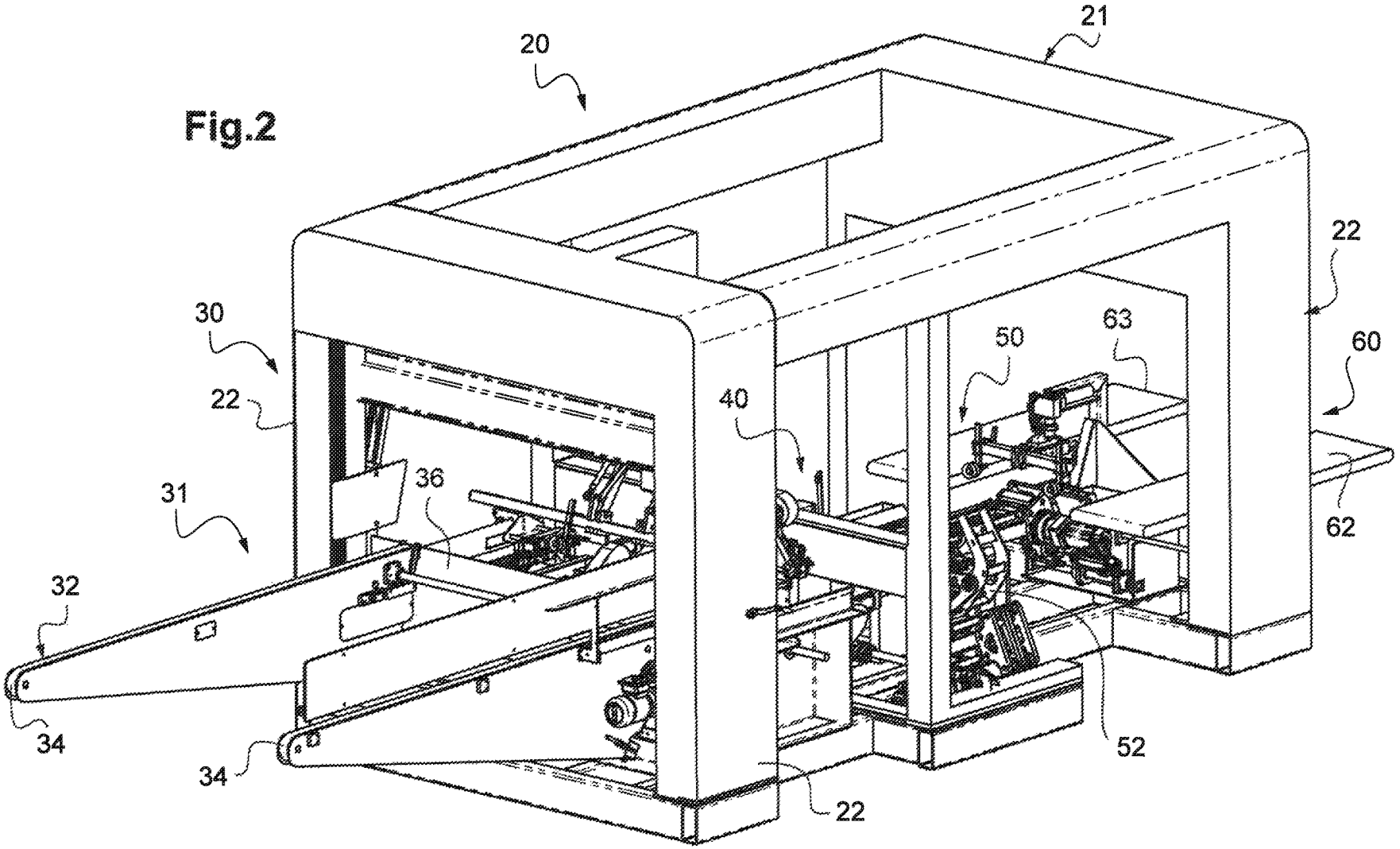
FIG. 2 is a perspective view of a machine for forming a box of polygonal cross section, from the blank illustrated in FIG. 1, including a gluing device according to the invention.
Figure 3:
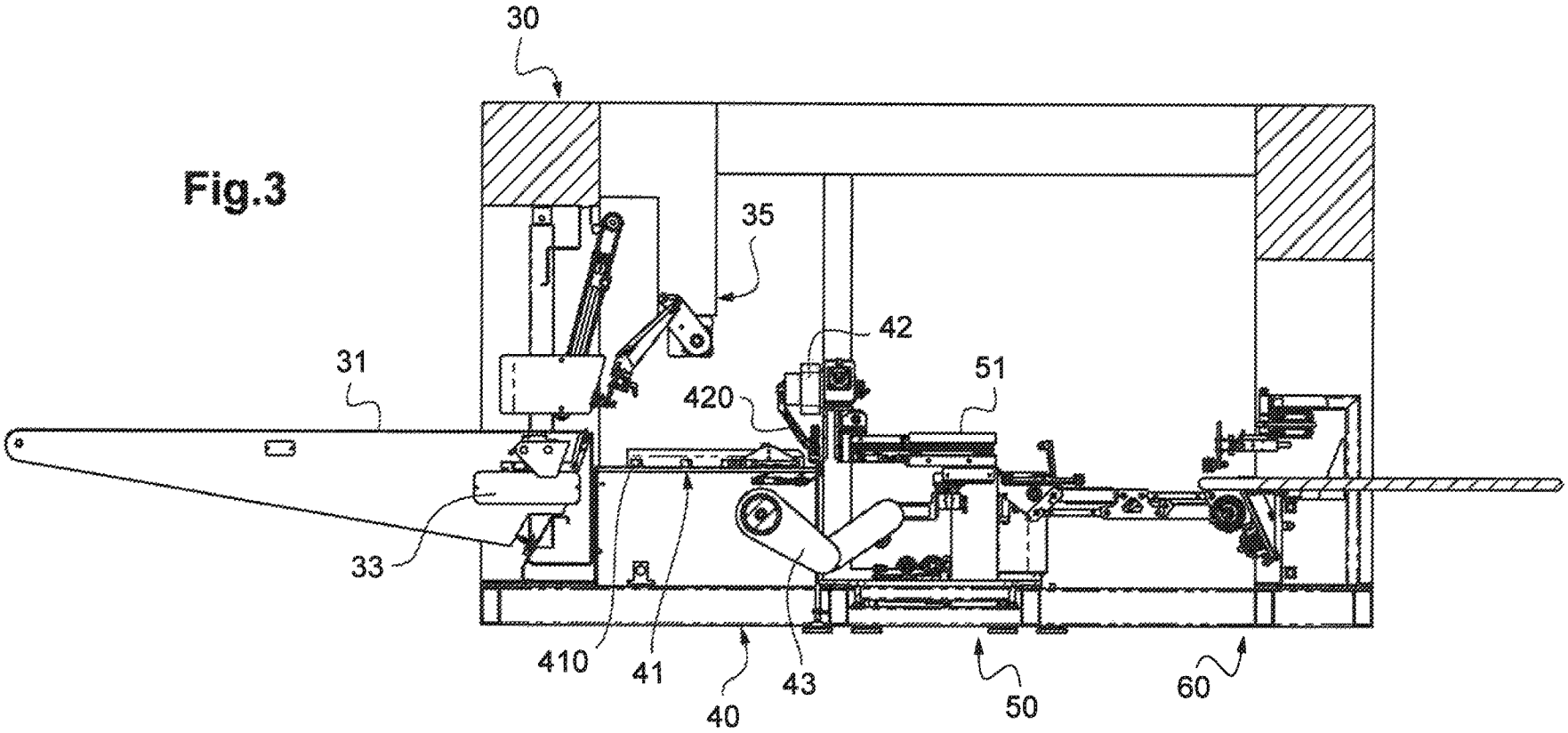
FIG. 3 is a side, longitudinal cross-sectional view of the machine illustrated in FIG. 2, more specifically on the right-hand side of the machine in the travel direction of the blanks.
Figure 4:
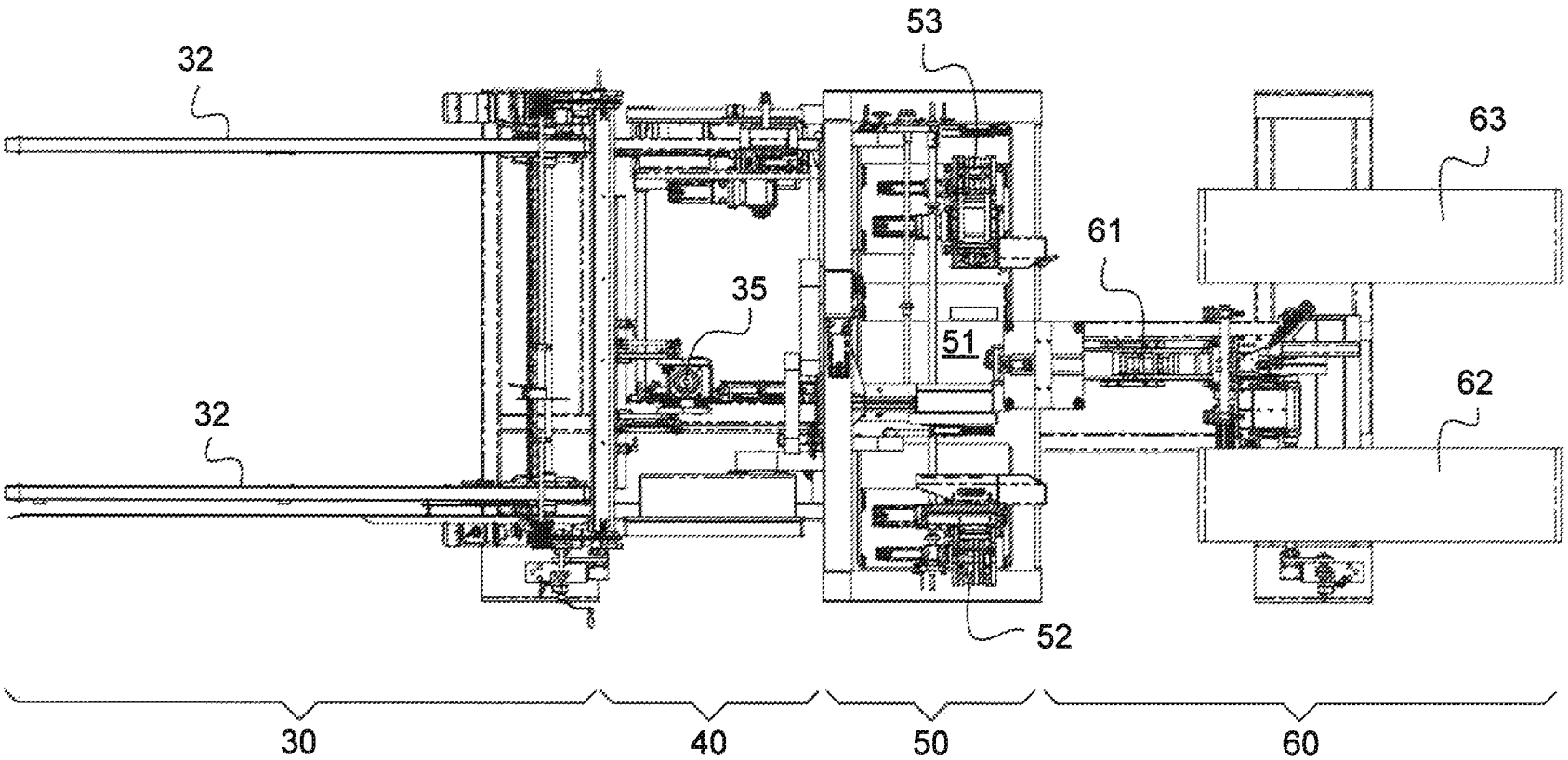
FIGS. 4 and 5 are top views of the machine illustrated in FIG. 2, FIG. 5 differing from FIG. 4 in that it also represents blanks during processing on the machine.
Figure 5:
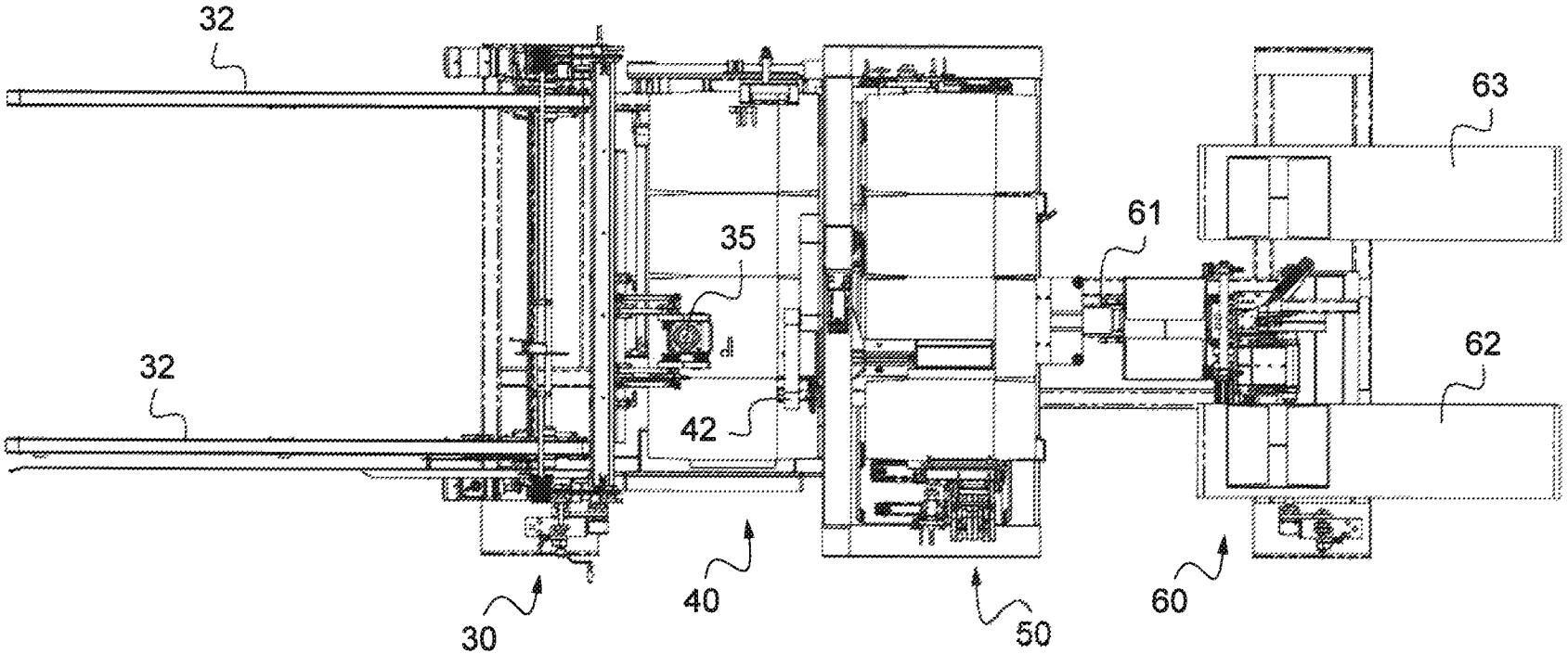

FIG. 6 illustrates the mandrel 51 and the blank 1, glued beforehand at the glue-application workstation 40.

The mandrel and the blank are illustrated here transversally to the circulation direction of the blanks in the machine 20 and seen from the rear of the machine. In other words, the tab 7 is located on the right, along the direction of movement of the blank 1 inside the machine 20 and on the left in FIG. 6.

In the implementation example of the method which will be described, the adhesive lines have been deposited in the proximity of the free edge of the panel 3, as well as on the flaps 16*a* and 16*c*. These adhesive lines have been deposited on the upper face of the blank which is illustrated in FIG. 1.

This upper face is that facing the mandrel 51 in FIG. 6 and it is opposite the lower face which is the printed face of the blank.

Of course, the invention is not limited to this implementation embodiment. In particular, the deposition of the adhesive lines could be done on the lower face of the blank, i.e. that facing the table 41, the printed face of the blank thus constituting the upper face thereof.

In this case, the adhesive lines will be deposited on the flaps 16*b* and 16*d*.

As indicated above, the blank 1 is moved from the glue-application workstation 40 up to under the mandrel 51 by transfer means 43 comprising a hinged arm system.

These transfer means have the advantage of being extremely precise. They make it possible, in particular, to remove all of the side guides which must be present when the transfer is made, for example, by driving finger means. They also make it possible to remove the front abutment which is normally provided to correctly position the blank under the mandrel. That is why this front abutment is not illustrated in the figures.

However, the invention is not limited to this implementation embodiment and the blank 1 could be moved from the glue-application workstation 40 up to the forming workstation 50 by conventional means being moved linearly.

FIG. 6 therefore illustrates the blank 1 after the positioning thereof under the mandrel 51 using transfer means 46 and the recovery thereof and the maintenance thereof by support means 54 and 55, located under the mandrel 51 and on which the blank 1 bears against the lower face thereof, when the means 43 have left the forming workstation to return to the glue-application workstation.

In the example illustrated in FIG. 6, these support means are in contact with at least some of the surface of the intermediate panel 5 and the extreme panel 3. Other solutions for supporting and/or maintaining the blank 1 can be considered without moving away from the scope of the present invention.

FIG. 6 shows that the support means 54 located under the mandrel comprise two side pads 540 and 541 and an intermediate support 542.

The mandrel 51 comprises an application face 510, intended to be facing the blank 1, an upper face 511, opposite the application face 510 on which will be flattened the main panel 3, as well as side faces 512 and 513, on which will be wrapped the main panels 4 and 6, and an end face 514 on which will be lowered the side flaps 16*a* to 16*d*.

The faces of the mandrel can be formed by plates, or also by angle irons, in a manner known in itself.

In the examples illustrated in the figures, the edges are straight lines.

When the blank 1 comprises rectangular secondary panels between the main panels, the mandrel 51 has edges with cut corners such that the secondary panels form the bevelled angles of the box obtained after forming.

By comparing FIGS. 6 and 7, it is understood that the mandrel 51 is mobile between a retracted position illustrated in FIG. 6 and a forming position, illustrated in FIG. 7.

In the retracted position illustrated in FIG. 6, the distance between the application face 510 of the mandrel and the opposite face 511 thereof is less than the width of the box which will be obtained from the blank 1.

This retracted position makes it possible for the transfer means 43 to make the blank 1 pass between the application face 510 of the mandrel and the support means 54 and 55.

In the forming position illustrated in FIG. 7, the outer cross section of the mandrel corresponds to the inner cross section of the box which will be obtained from the blank 1 and the application face 510 is in contact with the upper face of the blank 1.

In the embodiment example illustrated in FIGS. 6 and 7, the distance between the application face 510 and the opposite face 511 of the mandrel is adjustable, using suitable means such as actuators 515. The invention, however, is not limited to this embodiment and variants could be considered without moving away from the scope thereof.

It is understood that the side pads 540, 541 are positioned facing the mandrel such that the outer face 5400, 5410 thereof is substantially just under a side face 512, 513 of the mandrel 51.

This makes it possible to ensure an effective flattening of the intermediate panel 5 against the application face 510 of the mandrel.

The forming of the box around the mandrel is done by the cradles 52 and 53 which will be described in more detail in reference to FIGS. 8 and 9.

As indicated above, these two cradles are secured to the frame 21 of the machine and are arranged on either side of the mandrel (not illustrated in FIG. 8), transversally and symmetrically with respect to the direction in which the blank is brought in from the glue-application workstation.

Figure 8:
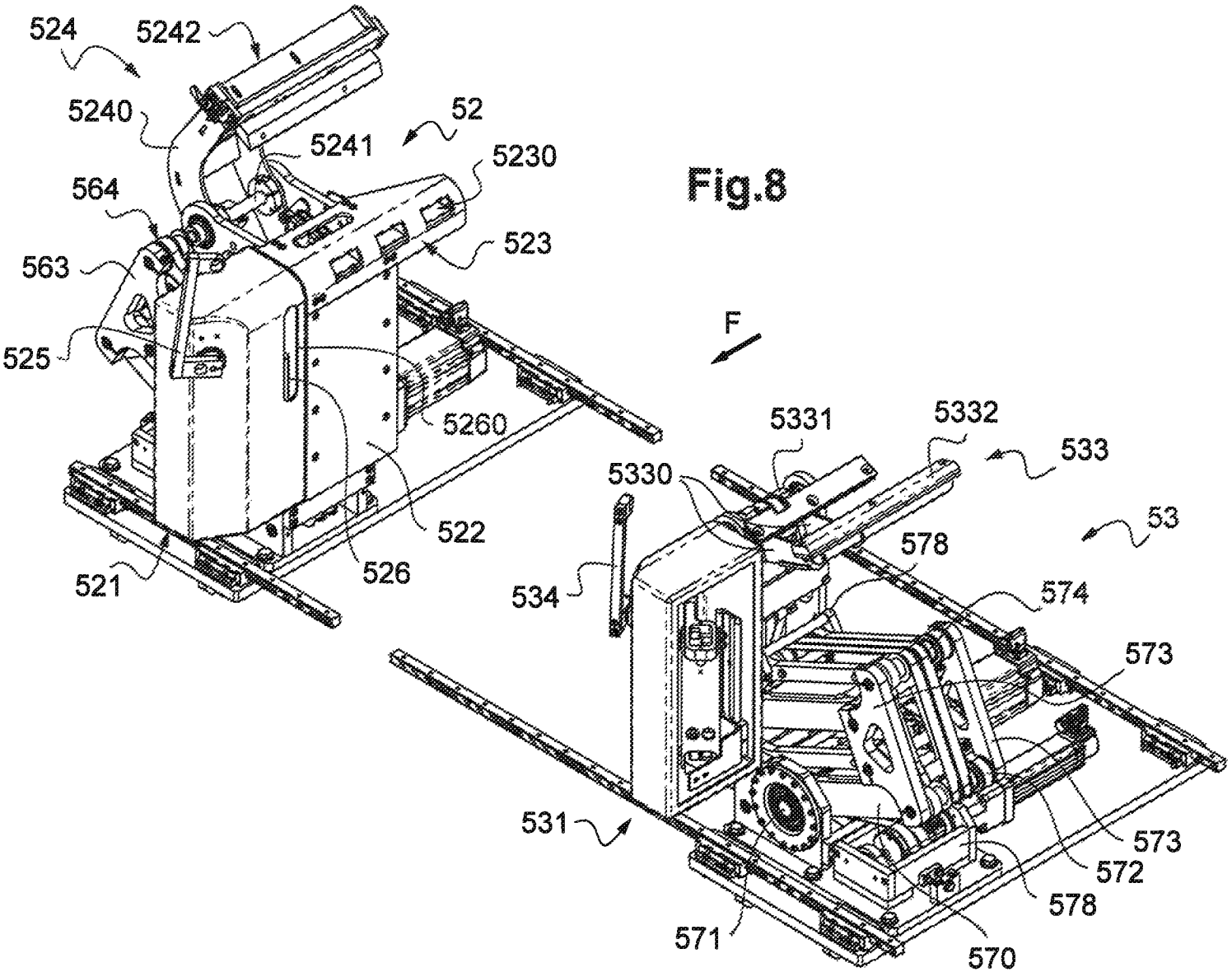
FIG. 8 is a perspective view representing the two cradles of the forming workstation.

The direction in which the blanks are conveyed inside the machine 20 is illustrated by the arrow F in FIG. 8.

Thus, the cradle 52 is illustrated on the side of the tab 7 of a blank positioned under the mandrel, while the cradle 53 will be positioned under the panels 3 and 4.

Each cradle 52, 53 comprises a hinged arm system 56, 57 achieved identically.

Thus, this hinged arm system 56, 57 comprises a pair of main arms 560, 570 folded to one another by two axes 561, 571 and 562, 572.

These two axes 561, 562 and 571, 572 are spaced from one another and extend substantially longitudinally, i.e. along the direction of movement of the blanks in the machine 20.

Each main arm 560, 570 supports an intermediate arm 563, 573.

The two intermediate arms 563, 573 are, at one of the ends thereof, mounted mobile in rotation about the axis 562, 572 common to the two main arms 560, 570.

At the end thereof opposite that mounted in rotation on the axis 562, 572, the intermediate arms 563, 573 are mounted mobile in rotation on an axis 564, 574 common to two secondary arms 565, 575.

In addition, the small connecting rods 566, 576, respectively 567, 577 each double the main arms 560, 570, respectively each of the secondary arms 565, 575.

The end of the secondary arms 565, 575 and small connecting rods 567, 577, opposite the intermediate arms 563, 573, is equipped with support means 568, 578 for a side flattener 521, 531 which comprises a sliding surface 522, 532. These two sliding surfaces extend in a longitudinal plane, substantially parallel to the side faces 512 and 513 of the mandrel and perpendicular to the blank 1, when it is positioned under the mandrel 51. They are designed to ensure the wrapping of the panel 6, 4 and the flattening thereof against the mandrel 51.

These cradles are designed to support all the means making it possible to form the box.

Thus, the cradle 52 supports means 523 to break and fold the tab 7 around the folding line 11 and means 524 to ensure the securing of the panel 3 on the tab 7, once folded.

The means 523 are provided in the proximity of the upper part 5220 of the sliding surface. They can be formed of an actuator having the shape of a three-toothed comb, each of them being likely to pass through an orifice 5230.

The means 524 comprise two arms 5240 (second hinged arm) substantially parallel and having a general L-shape.

These two arms 5240 are mounted in rotation on the side flattener 521, around a common axis 5241 which extends substantially longitudinally, by the free end of the first branch of the L.

As the figures illustrate, this axis 5241 is located behind the side flattener, with respect to the sliding surface 522.

At the free end of the second branch of the L, opposite the axis 5241, the arms 5240 support a plate 5242 which extends substantially perpendicularly to the second branch of the L formed by the arms 5240.

The cradle 52 also supports a hinged arm 525, located downstream of the folding means 523, in the circulation direction of the blanks illustrated by the arrow F.

This hinged arm 525 is intended to lower the side flap 16*a* (in the upper position) against the end face 514 of the mandrel 51, cooperating with the arm 534 of the cradle 53 which will be described below.

The cradle 53 itself supports a unit 533 to wrap the main panel 4 around the mandrel.

This unit comprises two arms 5330 substantially parallel and mounted in rotation around a common axis 5331 which is substantially longitudinal. This axis 5331 is located substantially at the upper end 5320 of the sliding surface 532 of the side flattener 531, opposite support means 578.

At the end thereof opposite the axis 5331, the arms 5330 (first hinged arm) support a plate 5332.

Moreover, the cradle 53 also supports a hinged arm 534 which is intended to lower the side flap 16*a* (in the upper position and opposite the flap 16*c*) on the end face 514 of the mandrel 51, cooperating with the arm 525 of the cradle 52.

This hinged arm is located downstream of the wrapping means 533 with respect to the direction of movement of the blanks, materialised by the arrow F. It is located substantially opposite the arm 525 of the cradle 52.

Finally, each cradle 52, 53 comprises means 526, 536 opposite to fold the side flaps 16*d* and 16*c*, on the end face 514 of the mandrel.

These means 526, 536 can consist of a finger likely to pass through a light, 5260, 5360 and actuated by a set of three actuators controlled according to the size of the flaps 16*d* and 16*c*.

Reference is now made to FIG. 9 which represents the cradle 53, seen from the side.

This FIG. 9 illustrates the side flattener 531 which supports the plate 5332 and the arm 534.

It also illustrates the means for actuating the arm 534, comprising an actuator system 5340.

FIG. 9 shows the folding means 536 and the actuation means thereof.

It also shows the belts 575 which generate the movement of the hinged arm system 57, using the motor 578.

The cradle 52 comprises means for driving the hinged arm system 56 which is similar.

In practice, the motors associated with each of these hinged arm systems are controlled such that the two hinged arm systems 56, 57 are moved by the same movement, during the wrapping of the panels on the mandrel.

Reference is now made to FIGS. 10 to 14 to explain the different steps of forming a blank around the mandrel 51, using two cradles 52 and 53.

Figure 10:
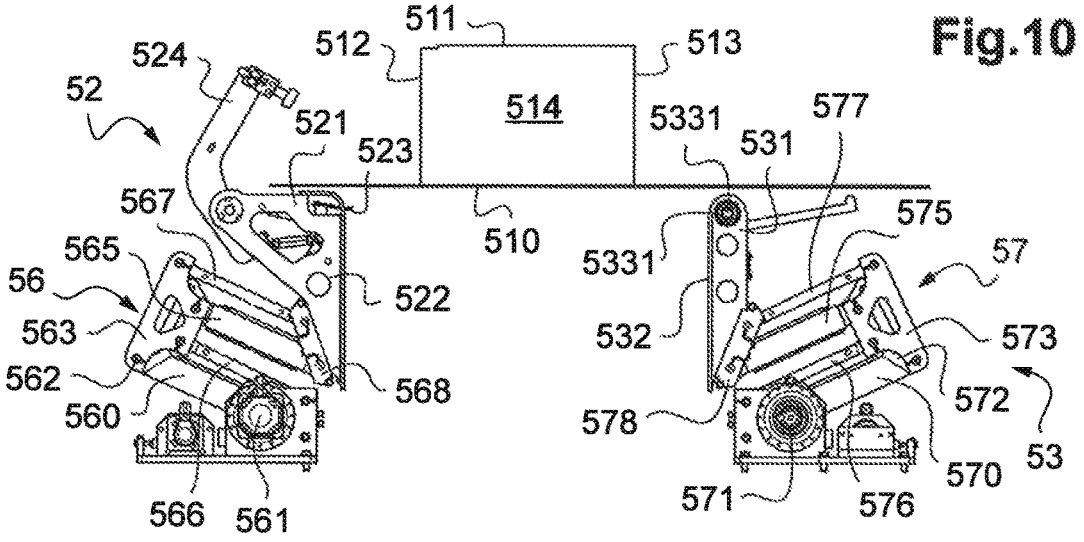
FIGS. 10 to 14 are cross-sectional views illustrating the different steps of forming the blank on the mandrel.

FIG. 10 illustrates the relative position of the mandrel 51 and of the blank 1 before the forming starts.

This position is that illustrated in FIG. 7. It is understood that the blank 1 must be positioned precisely with respect to the mandrel 51. Indeed, the wrapping of the panels is done after flattening the blank against the application face 510.

This context is therefore different from that of patent EP 0 334 707 which describes a method wherein the wrapping of the blank starts, while the flattening thereof against the mandrel has not been done.

In practice, the panel 5 is therefore in contact with the application face 510, while the panel 6 extends from the side of the cradle 52 and the panels 3 and 4 from the side of the cradle 53.

In this position, the hinged arm systems 56, 57 are in the folded position, as illustrated in FIG. 8.

Figure 12:
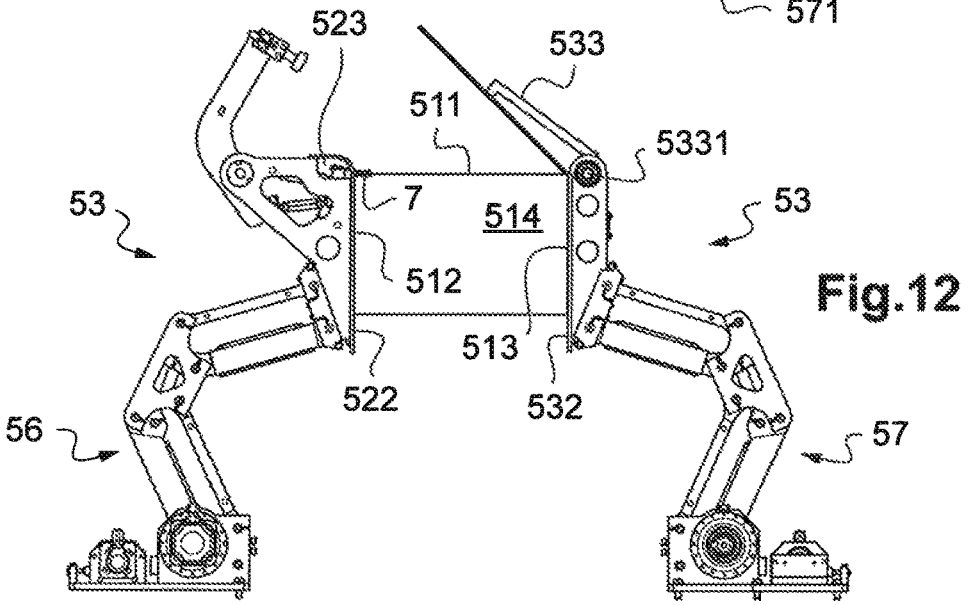

These two systems are then controlled to pass into the deployed position illustrated in FIG. 12.

During the passing from the folded position to the deployed position, the rotation movements of the main and secondary arms, as well as intermediate arms print on each side flattener 521, 531, a combined movement towards the top and towards the inside of the machine.

Figure 11:
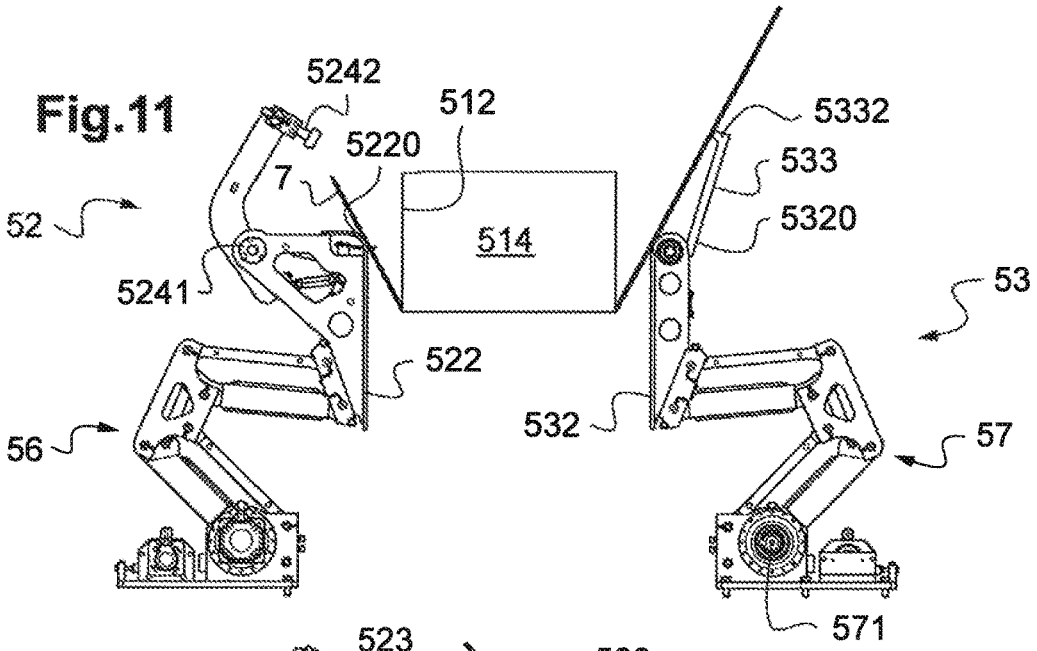

FIG. 11 illustrates an intermediate position between the folded position of FIG. 10 and the deployed position of FIG. 12.

In this intermediate position, the upper part 5220 of the sliding surface 522 is in contact with the lower (printed) face of the panel 6. The movement of the sliding surface 522 causes the wrapping of the panel 6 around the mandrel and the folding thereof around the folding line 10.

Likewise, the upper part 5320 of the sliding surface 532 is in contact with the panel 4, while the plate 5332 of the unit 533 is in contact with the lower face of the panel 3.

The movement of the sliding surface 532 makes it possible to wrap the panel 4 around the mandrel and to fold it around the folding line 8, the plate 5332 making it possible to maintain the panel 3 in the extension of the panel 4.

In the deployed position of the cradles illustrated in FIG. 12, the panel 6 is flattened against the side surface 512 of the mandrel, using the sliding surface 522.

Moreover, the folding means 523 are actuated to fold the tab 7, around the folding line 11. It is thus in contact with the upper face 511 of the mandrel.

At the same time, the sliding surface 532 of the cradle 53 flattens the panel 4 against the side face 513 of the mandrel. In addition, the arms 5330 rotate in the anti-clockwise direction around the axis 5331 to fold the panel 3 around the folding line 9.

Figure 13:
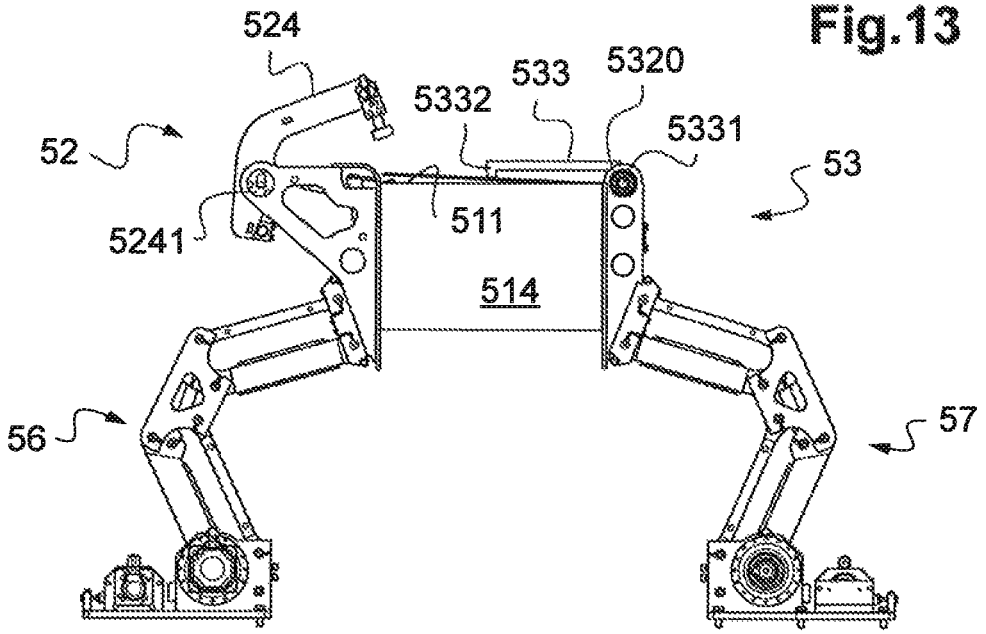

In the following step illustrated in FIG. 13, the two cradles 52, 53 remain in the deployed position illustrated in FIG. 12.

In this position, the wrapping arms 5330 continue the rotation thereof around the axis 5331 in the anti-clockwise direction, which ensures the flattening of the panel 3 against the upper face 511 of the mandrel using the plate 5332.

Alongside this, the movement of the arms 5240 is started around the shaft 5241, in the clockwise direction.

In this position, the folding means 526, 536 are actuated, so as to fold the side flaps 16*d* and 16*b* around the folding lines 14 to flatten them against the end face 514 of the mandrel.

The arms 525 and 534 are then actuated to fold the upper flap 16*a* against the side flaps 16*b* and 16*d* already folded, by folding around the folding line 14.

Figure 14:
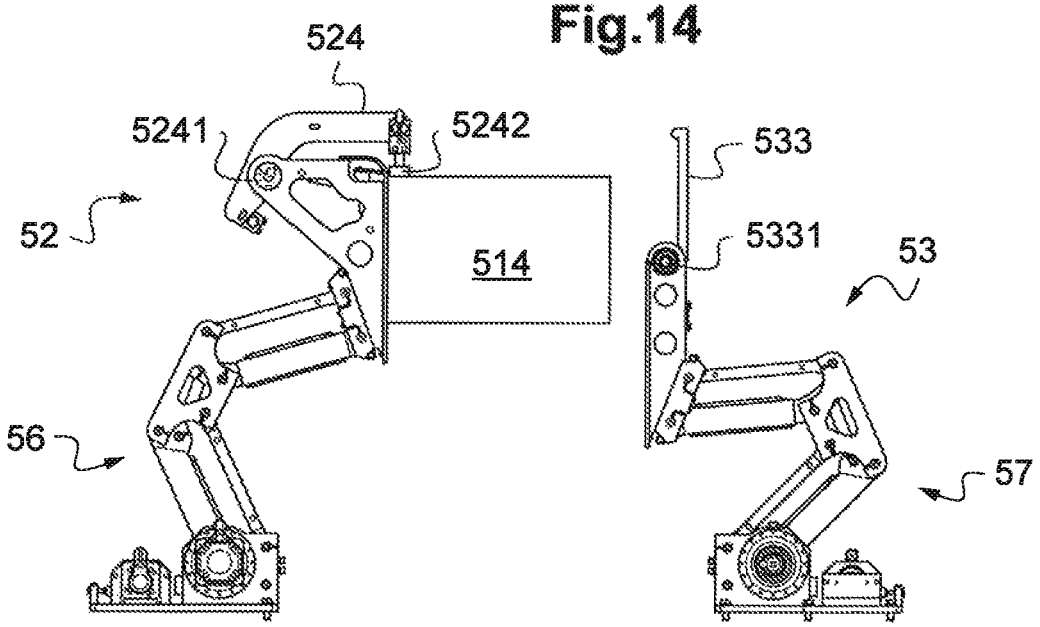

FIG. 14 illustrates the following step during which the rotation movement of the arms 5240 around the axis 5241 is continued, such that the plate 5242 bears against the panel 3 and ensures the securing thereof on the tab 7, by pressing, using the adhesive present in the proximity of the free edge of the panel 3.

If the adhesive line was not present in the proximity of the free edge of the panel 3 but on the upper face of the tab, the folding means 523 would thus only be actuated after the unit 533. Thus, first the flattening of the panel 3 against the upper face 511 of the mandrel would be proceeded with, then the folding of the tab 7 around the folding line 11, using the means 523. Finally, the arms 5240 would be actuated so as to press the tab 7 against the panel 3 to ensure the securing thereof using the adhesive present on the tab.

As FIG. 14 illustrates, when the plate 5242 ensures the securing between the tab 7 and the panel 3, the cradle 53 can start the movement thereof towards the folded position.

Once achieved, the securing of the tab 7 on the panel 3, the cradle 52 will also start the movement thereof towards the folded position in the two cradles 52 and 53 will thus be in the folded position illustrated in FIG. 10, the arms 5240 having tilted towards the rear, using a rotation movement in the anti-clockwise direction about the axis 5241. The forming of a new blank around the mandrel 51 can thus occur.

Means are also provided to fold the flap 16*c* around the folding line 14 and to secure it against the flaps 16*b* and 16*b* already folded against the end face 514 of the mandrel.

These means are not illustrated in detail in the figures as they are conventional. They can be carried by the side flatteners 521, 531 or be provided, for example, on the extractor means 61 of the extraction module 60.

Thus, all the means ensuring the shaping of the blank around the mandrel, the securing of the tab against the free edge of the extreme panel opposite the tab and the folding of at least two flaps being located on the same side of the flaps against an end face of the mandrel are carried by the cradles 52, 53 and, in particular, by the side flatteners 521, 531.

The positioning of these different means with respect to one another is secured in advance, during the design of the cradle.

The device according to the invention therefore requires no adjustment to ensure the correct functioning thereof.

Moreover, the fact that all these means are grouped together on the cradles makes it possible to limit the volume and to avoid, in particular, the presence of arms secured to the upper part of the frame, the space between the mandrel and the frame being released overall.

It is also noted, that all the movements are rotation movements, that these are movements making it possible to drive the side flatteners or the movements of different means carried by the cradles.

The securing of the flaps 16*a* and 16*c*, equipped with adhesive on the upper face thereof, on the flaps 16*b* and 16*d* folded beforehand on the end face 514 of the mandrel ensures a securing of all of the four side flaps which is more solid than when the adhesive is present on the lower face of the side flaps 16*b* and 16*d*, and that the flaps 16*a* and 16*c* are folded to one another.

Finally, insofar as the adhesive is present on the upper face of the blank and that the different means carried by the cradles are in contact with the lower (printed) face of the blank, there is no risk that these means come into contact with the adhesive lines deposited beforehand. This decreases the precision requirements at the level of the adjustments of different means and, in particular, of the unit 533 and securing means 524.

The functioning of the machine making it possible for the forming of a box will now be described, in reference to the figures.

From the magazine 31 for storing blanks, a first blank 1 is extracted and it is made to tilt horizontally.

It is thus dropped on the table 41 and it is precisely positioned on the table 41.

With the blank being immobile, adhesive lines are deposited on at least two side flaps 16*c* and 16*a*, on the upper face of the blank, the lower face constituting the printed face of the blank.

The blank is then transferred from the glue-application workstation to the forming workstation and the deposition of an adhesive line is proceeded with, during this transfer, in the proximity of the free edge of the panel 3 or on the tab 7.

With the blank 1 being positioned under the mandrel, the wrapping thereof around the mandrel is proceeded with, here by means of two cradles 52 and 53 described above.

From the forming step, the panel 3 is glued on the tab 7 and the side flaps 16*a* and 16*c* are glued on the flaps 16*b* and 16*d* to form the bottom of the box on the end face 510 of the mandrel. The latter is rotated on the side of the extraction module 60.

This extracted, by any suitable means, the box thus formed from the mandrel 51, so as to deposit it on either of the conveyors 62 or 63.

The description above also applies to the forming of a part of box, in particular a cover or a bottom.

Of course, this method is implemented in the scope of a successive and automatic forming of boxes or parts of boxes, such that the blank n is glued during the forming of the blank n−1.

It goes without saying, and as it results also from the above, the present invention is not limited to the embodiments more specifically described. On the contrary, all variants are included, and in particular those where the means for moving the blank under the mandrel are formed by a mat secured to the means for positioning the blank precisely for gluing.

The invention claimed is:

1. A device for shaping a blank made of material in sheet form around a mandrel, to obtain a box or a part of box of polygonal cross section, said blank comprising a continuation of at least three panels, namely two extreme panels on either side of at least one intermediate panel, said panels being connected to one another by parallel folding lines and provided with side flaps, connected respectively to said panels by folding lines perpendicular to the folding lines connecting said panels, a free edge of one of the extreme panels being provided with a tab connected to said extreme panel by a folding line parallel to the folding lines connecting said panels, said blank being glued beforehand in a glue-application workstation, on the one hand on two flaps and on the other hand, on the tab of the extreme panel or in a proximity of the free edge of the extreme panel opposite said tab, the device comprising:

a frame;

a mandrel of polygonal cross section of which the outer cross section corresponds to an inner cross section of the box or part of box to be obtained;

means for wrapping panels and the tab around the mandrel;

means for securing the tab against the free edge of the extreme panel opposite the tab;

means for folding flaps located on the same side of said panels against a corresponding end face of the mandrel; and means for securing to one another, the flaps thus folded, wherein the means for wrapping the panels and the means for securing the tab are supported by two cradles secured to the frame of the device and arranged on either side of the mandrel, transversally and symmetrically with respect to a direction in which the blank is brought in from the glue-application workstation, wherein the means for wrapping panels comprise means equipped with a sliding surface for lowering a panel of the blank on one of two side faces opposite the mandrel and respectively, for one of the cradles, means for lowering a panel and for the other cradle, means for folding the tab around the edge of an upper face of the mandrel, and wherein each cradle comprises a hinged system to vertically and transversally move the wrapping means.

2. The device according to claim 1, wherein the means for lowering a panel comprise a first hinged arm mounted mobile in rotation on the means equipped with a sliding surface.

3. The device according to claim 1, wherein the other cradle also supports the means for securing the tab, said means comprising a second hinged arm mounted in rotation on the means equipped with a sliding surface of said cradle and equipped with means for compressing the tab against the free edge of the extreme panel opposite the tab.

4. The device according to claim 1, wherein at least some of the means for folding the flaps are also supported by the two cradles.

5. The device according to claim 1, wherein the device further comprises means for supporting or maintaining at least some of a surface of an intermediate panel of the blank and the mandrel comprises an application face of said intermediate panel on the support or maintenance means, side faces and an upper face opposite the application face.

6. The device according to claim 5, wherein the mandrel is mobile between a first position for forming the box or part of box, wherein the outer cross section thereof corresponds to the inner cross section of the box or part of box to be obtained and a second retracted position, wherein a distance between the application face and the opposite upper face of the mandrel is smaller than a width of the box or part of box to be obtained.

7. The device according to claim 5, wherein a distance between the application face and the opposite upper face of the mandrel is adjustable.

8. The device according to claim 5, wherein the edges of the mandrel have cut corners.

9. A machine for forming a box or a part of box of polygonal cross section comprising a glue-application workstation wherein a blank made of material in sheet form, comprising a set of panels connected to one another by parallel folding lines and provided with side flaps, connected respectively to said panels by folding lines perpendicular to the folding lines connecting said panels, the free edge of one of the extreme panels of said set of panels being provided with a tab connected to said extreme panel by a folding line parallel to the folding lines connecting said panels, is glued at least, on the one hand, on two side flaps and on the other hand, on the tab of an extreme panel or in a proximity of a free edge of the extreme panel opposite said tab and a forming workstation comprising the shaping device according to claim 1.

10. A method for shaping a blank made of material in sheet form around a mandrel to obtain a box or a part of box of polygonal cross section, said blank comprising a continuation of at least three panels, namely two extreme panels on either side of at least one intermediate panel, said panels being connected to one another by parallel folding lines and provided with side flaps, connected respectively to said panels by folding lines perpendicular to the folding lines connecting said panels, a free edge of one of the extreme panels being provided with a tab connected to said extreme panel by a folding line parallel to the folding lines connecting said panels, the method implementing a shaping device equipped with a frame, wherein the blank is glued beforehand at a glue-application workstation of the device, the panels are wrapped around a mandrel of polygonal cross section of which the outer cross section corresponds to an inner cross section of the box or part of box to be obtained, the tab is secured against the free edge of the other extreme panel bearing against an upper face of the mandrel, the flaps located on the same side of said panels are folded against a corresponding end face of the mandrel and then secured to one another, wherein wrapping of the panels and of the tab, and securing of said tab result from translation and rotation movements made by means supported by two cradles secured to the frame of the shaping device, arranged on either side of the mandrel, transversally and symmetrically with respect to the direction in which the blank is brought in from the glue-application workstation, wherein the means for wrapping panels comprise means equipped with a sliding surface for lowering a panel of the blank on one of two side faces opposite the mandrel and respectively, for one of the cradles, means for lowering a panel and for the other cradle, means for folding the tab around the edge of the upper face of the mandrel, and wherein each cradle comprises a hinged system to vertically and transversally move the wrapping means.

11. The method according to claim 10, wherein folding of at least some of the flaps is also done from means supported by the cradles.

12. The method according to claim 10, wherein the mandrel comprises an application face of the intermediate panel on means for supporting or maintaining of the shaping device for at least some of a surface of the intermediate panel, the mandrel being in a retracted position, wherein a distance between the application face of the intermediate panel and an upper face of the mandrel, opposite the application face, is smaller than a width of the box or part of box to be obtained, when the blank coming from the glue-application workstation is positioned under the mandrel, and in a forming position, wherein the outer cross section of the mandrel corresponds to the inner cross section of the box or part of box to be obtained, once the intermediate panel on the support or maintenance means, to press said intermediate panel on the support or maintenance means by the application face of the mandrel.

13. The method according to claim 12, wherein the blank is brought in from the glue-application workstation under the mandrel by a translation movement of direction parallel to the folding lines between the panels of the blank, the mandrel being arranged at a fixed position.

14. The method according to claim 13, wherein the blank is secured by suction with the means ensuring the translation movement thereof to ensure precise positioning thereof under the mandrel.

15. A method for forming a box or a part of box of polygonal cross section from a blank comprising a set of panels connected to one another by parallel folding lines and provided with side flaps, connected respectively to said panels by folding lines perpendicular to the folding lines connecting said panels, wherein the blank is glued in a glue-application workstation then shaped around a mandrel by implementing the method according to claim 10.

16. A method for successively, automatically forming boxes or parts of boxes implementing a method according to claim 10, characterised in that the blank n−1 is formed during the gluing of the blank n.

* * * * *